US005517973A

United States Patent [19]

Askew et al.

[11] Patent Number: 5,517,973

[45] Date of Patent: May 21, 1996

[54] FUEL PUMP

[75] Inventors: James M. A. Askew; Gerald S. Thomas, both of Gloucester, England

[73] Assignee: Lucas Industries Public Limited Company, Solihull, England

[21] Appl. No.: 207,202

[22] Filed: Mar. 8, 1994

[30] Foreign Application Priority Data

Mar. 30, 1993 [GB] United Kingdom ..... 9306603

[51] Int. Cl.[6] ..... F02M 37/04

[52] U.S. Cl. ..... 123/506; 417/490

[58] Field of Search ..... 123/506; 417/440, 417/490

[56] References Cited

U.S. PATENT DOCUMENTS 4,074,666 2/1978 Indra ..... 123/506 X
4,343,280 8/1982 Luscomb ..... 123/459
4,705,006 11/1987 Bastenhof ..... 123/506
5,373,828 12/1994 Askew et al. ..... 123/506

FOREIGN PATENT DOCUMENTS 0049458 4/1982 European Pat. Off. .

*Primary Examiner*—Richard E. Gluck
*Attorney, Agent, or Firm*—Jacobson, Price, Holman & Stern

[57] ABSTRACT

A fuel injection pump includes a pump barrel (12) against (12) against which is located in sealing relationship a valve block (22). A plunger (15) is reciprocably mounted in a bore (14) in the barrel (12) and the valve block (22) contains a spill valve (26) which can spill fuel from the bore (14) during the inward movement of the plunger. An inlet port (21) is formed in the wall of the bore (14) and is uncovered by the plunger (15) during its outward movement. The inlet port communicates with a first annular space (13) defined between the pump barrel and a surrounding pump body (10). The spilled fuel flows through the spill valve into a second annular space (55) defined between the valve block and the body. The first and second annular spaces have a respective inlet and outlet and are substantially isolated from each other.

10 Claims, 2 Drawing Sheets

FUEL PUMP

This invention relates to a fuel injection pump for feeding fuel to a fuel injection nozzle of the type wherein a reciprocable plunger is actuated by an element which produces inward movement of the plunger In a bore in a pump barrel, and an electromagnetically operable valve means which in the closed position prevents spillage of fuel from the bore.

BRIEF SUMMARY OF THE INVENTION

The object of the invention is to provide an improved pump of the kind referred to above.

This invention is in a fuel injection pump having a generally tubular body, a flanged pump barrel located against a step defined in the body, a bore formed in the barrel, a pumping plunger slidable in the bore and extending from one end thereof, a valve block located within the body, means for generating a clamping force between the presented surfaces of the barrel and the valve block, the valve block acting to close the other end of the bore and housing a spill valve, which controls fuel flow from the other end of the bore, an electromagnetically operable valve for controlling the operation of the spill valve, a pump outlet communicating with the other end of the bore, resilient means for biasing the plunger outwardly of the bore, a port formed in the wall of the bore in the pump barrel, the port being uncovered during the outward movement of the plunger to allow fuel flow into the bore and means engageable with the plunger for effecting inward movement thereof.

According to the invention in a pump of the kind specified the port opens into a first annular space defined between the pump barrel and the tubular body, and there is defined about the valve block a second annular space into which fuel from the bore is spilled when the spill valve is operated to terminate delivery of fuel, and a fuel inlet and a fuel outlet communicating with the first and second spaces respectively, the spaces being substantially isolated from each other.

BRIEF DESCRIPTION OF THE DRAWINGS

An example of a fuel pump in accordance with the invention will now be described in detail with reference to the accompanying drawings wherein.

DETAILED DESCRIPTION

Figure 1:
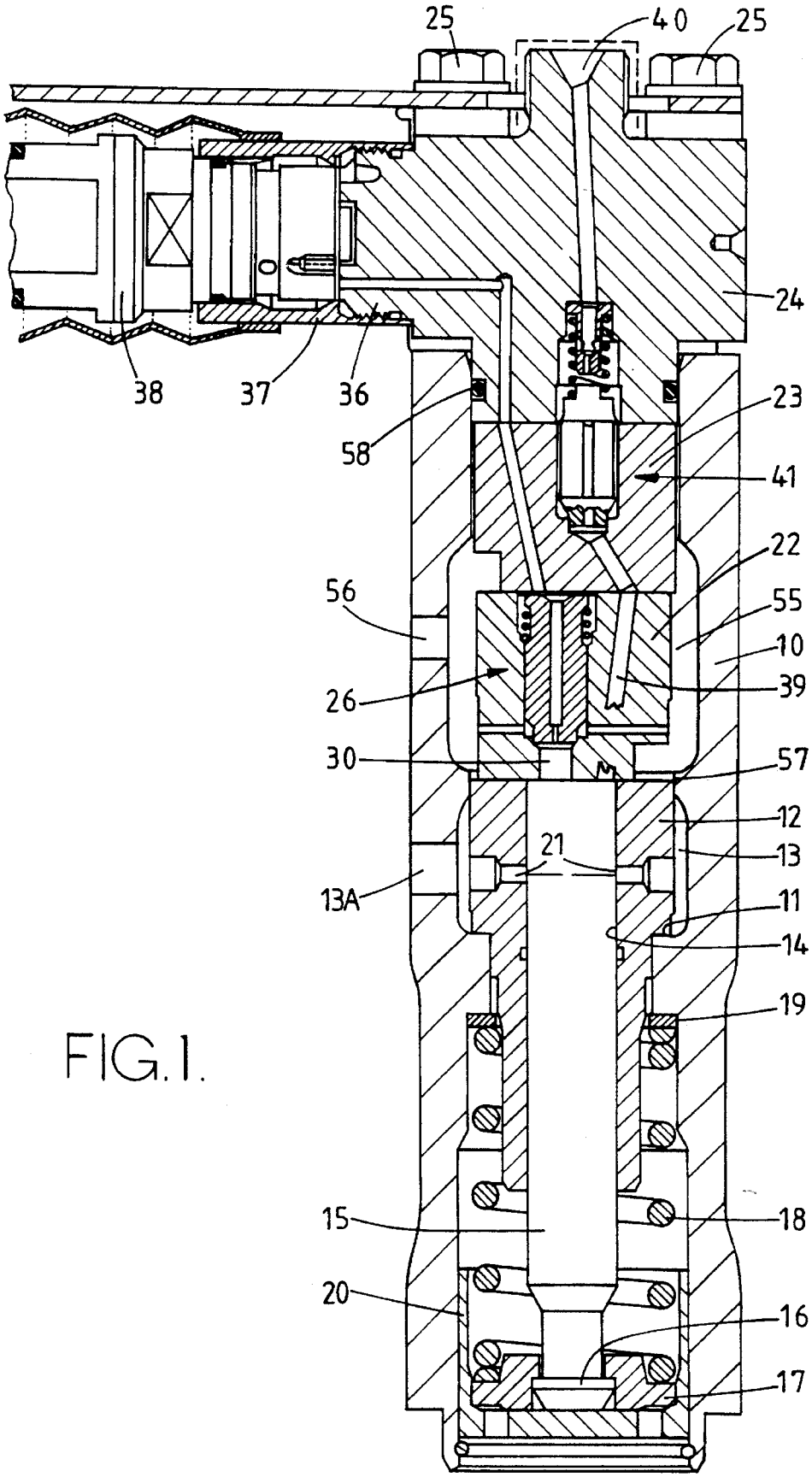
FIG. 1 is a cross sectional view of the pump of the invention.

Referring to FIG. 1 of the drawings the pump comprises a generally tubular body 10 and located against an annular step 11 in the body is a complementary step defined by a flanged portion of a pump barrel 12. Surrounding the flanged portion of the barrel is a first annular space or chamber 13 which is formed in the pump body and with which communicates a fuel inlet 13A also formed in the pump body, the fuel inlet being connected in use to a source of fuel under pressure. Within the barrel there is formed a bore 14 and slidable within the bore is a pumping plunger 15. The plunger extends from the bore and is provided with a head 16 with which is engaged a spring abutment 17. Engaged with the abutment 17 is one end of a coiled compression spring 18 the opposite end of which abuts against a shim 19 which is interposed between the spring and a further step defined in the body. The interior surface of the body in the region of the spring abutment is machined to form a bearing surface for a cup shaped tappet 20 which engages with the head 16 of the plunger. The tappet is retained within the body in known manner, by means of a circlip and in use, is urged inwardly by an engine driven cam. The plunger is shown in its outermost position and in this position the end of the plunger remote from the head uncovers a pair of inlet ports 21 which communicate at their outer ends, with the annular space 13. The ports 21 are covered during the initial inward movement of the plunger.

Also provided is a pair of valve blocks 22, 23, which are located in end to end relationship with the first valve block 22 being in engagement with the end surface of the pump barrel. The first block 22 is held in sealing engagement with the adjacent end face of the pump barrel and with the adjacent face of the second valve block 23 by means of a mounting block 24 which has a portion located within the body 10 and defining an end surface for sealing engagement with the adjacent end surface of the valve block 23. The mounting block is secured by means of bolts 25 to the body 10 and the action of tightening the bolts produces a clamping force which provides the required liquid seal between the adjacent contacting surfaces of the mounting block, the valve blocks and the pump barrel. The mounting block and the valve blocks can be secured together by screws to facilitate assembly and also to determine their angular relationship.

Figure 2:
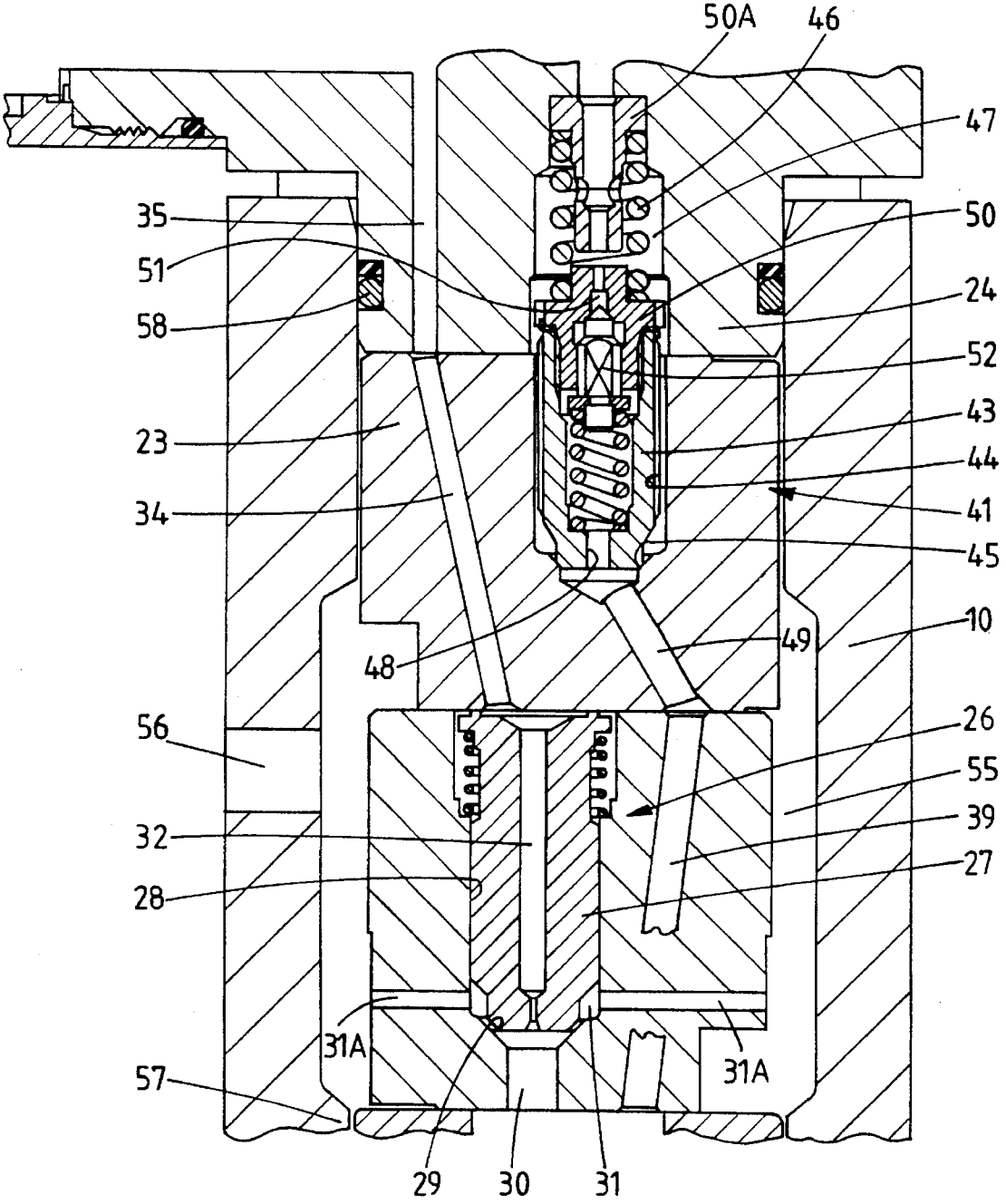
FIG. 2 is a cross sectional view on an enlarged scale of part of the pump which is seen in FIG. 1.

The first valve block 22 houses a spill valve generally indicated at 26 and this takes the form as seen in FIG. 2, of a valve member 27 slidable axially within a drilling 28 extending inwardly from the end face of the valve block which is engaged by the valve block 23. At its inner end the drilling defines a seating 29 about a spill passage 30 which communicates with the adjacent end of the bore 14. The valve member at its end adjacent the seating is of reduced diameter so as to define an annular space 31 which communicates with a second annular space or chamber 55 by way of a pair of passages 31A formed in the valve block and which form a continuation of the spill passage 30. The space 55 is formed in the pump body about the valve block 22 and conveniently has a larger outer diameter than the space 13. Moreover, in communication with the space is a fuel outlet 56 which is formed in the body 10 and in use is connected to a suitable drain. The end of the valve member 27 is shaped to cooperate with the seating 29 and within the valve member and extending inwardly from the end of the valve member remote from the seating is an axial passage 32 which terminates in a restriction through which the passage communicates with the spill passage 30. At the end of the valve member remote from the restriction the opening of the passage is flared so as to afford permanent communication with a passage 34 which is formed in the valve block 23. The passage 34 communicates with a further passage 35 formed in the mounting block 24 and which opens onto the end surface of a peripherally screw threaded spigot 36 machined on the mounting block. The spigot carries a sleeve 37 into which is screwed the body of an electromagnetically operable valve 38. The valve is such that when electric current is supplied to the solenoid thereof, the passage 35 is closed and when the solenoid is de-energized, the passage is connected to a fuel drain.

Also formed in the first valve block 22 is a passage 39 which forms part of a fuel delivery channel which terminates in a pump outlet 40 formed on the mounting block 24. The pump outlet 40 in use, is connected to a fuel injection nozzle of the associated engine.

Located in the fuel delivery channel is a delivery valve generally indicated at 41 in FIG. 1 and which is shown to a substantially enlarged scale in FIG. 2. The delivery valve comprises a valve element 43 which is provided with longitudinal flutes on its external surface whereby the valve element is guided in a bore 44 formed in the valve block 23. The valve element is biased into engagement with a seating 45 by means of a coiled compression spring 46 which conveniently is housed within a chamber 47 formed in the mounting block 24. The valve member is of hollow cup shaped form and formed in the base thereof is an opening 48 through which the interior of the valve member is in permanent communication with a passage 49 upstream of the seating 45, the passage 49 communicating with the passage 39 in the valve block 22. Within the open end of the valve member there is located a valve housing 50 in which is formed a drilling 51 at the inner end of which is a seating for a spring loaded valve 52, the valve 52 being fluted. The valve housing 50 may be in screw thread engagement with the valve member 43 and it forms an abutment for the spring 46. The opposite end of the spring 46 engages a step defined on a stop member 50A which is located in the chamber 47 and which serves to limit the extent of movement as will be described, of the valve member 43. The stop member defines a central passage having in addition side entries, this passage forming part of the fuel delivery channel.

The operation of the pump will now be described from the point at which the plunger 15 is moved inwardly from the position shown in FIG. 1 by the engine driven cam. During the initial inward movement of the plunger fuel will be displaced from the bore through the inlet ports 21 but as soon as these ports are covered, fuel will be displaced from the bore through either the spill passage 30 or the fuel delivery channel 39 depending upon whether the spill valve 26 is in the open or the closed position. If the spill valve is in the open position, fuel will flow through the spill passage 30 into the chamber 55, and through the outlet 56 to a drain. Some flow of fuel will occur into the passage 32 by way of the restriction but such fuel will flow to drain by way of the open electromagnetically operable valve 38. If the valve 38 is energized the flow of fuel through the passage 32 will be prevented and this will cause a build up of pressure in the end portion of the cylinder 28 remote from the seating. The build up of pressure in view of the fact that there will be a pressure difference between the fuel in the spill passage 30 and the fuel in the passages 31A and the chamber 55, will result in the valve member 27 moving into engagement with the seating 29 and when this occurs further flow of fuel through the spill passage 30 is prevented. The fuel therefore must flow through the fuel delivery channel towards the fuel injection nozzle. The result will be that the valve element 43 of the delivery valve will be lifted from its seating to permit such flow and this flow will continue so long as the plunger is being moved inwardly by the cam and the spill valve is in the closed position.

If while the plunger is moving inwardly, the electromagnetically operable valve 38 is de-energized, the fuel pressure at the end of the cylinder 28 connected to the valve 38 will fall and the high pressure within the bore will cause the spill valve to be lifted from its seating to allow fuel to spill from the bore along the spill passage 30. The reduction in pressure will permit the valve member in the fuel injection nozzle to close and also will allow the delivery valve element 43 to move into engagement with the seating 45. A reverse flow of fuel from the pipeline which connects the pump with the nozzle may occur, such reverse flow being controlled by the valve 52 which can be set so that a predetermined pressure is maintained in the pipeline, the pressure being less than the pressure required to open the valve member of the nozzle.

It will be appreciated that the closure of the electromagnetic valve 38 whilst the plunger is moving inwardly determines the instant of fuel delivery to the associated engine and the length of time considered in terms of engine crankshaft rotation during which the valve is closed, determines the amount of fuel which is supplied to the engine.

As seen in FIG. 2, a light spring is provided to bias the valve member 27 of the spill valve to the open position however, this is not essential and the valve will function as described, without the spring. Moreover, as described the delivery valve 41 is a pressure unloading valve. However, by providing a collar on the skirt of the valve member 43 a volume unloading valve is obtained. The collar may be a close sliding fit with the wall of the bore 44 in which case it will be exposed beyond the end of the bore when the delivery valve is in the fully open position. The collar may however have a clearance with the bore in which case it may not be moved beyond the end of the bore.

As shown in FIG. 1 the axes of the bores 28 and 44 which house the spill valve and the delivery valve respectively are offset from the axis of the bore 14. The machining of the bores 28, 44 is facilitated by the fact that the end portions of the valve blocks remote from the open ends of the bores are of cylindrical form and have their axes coinciding with the longitudinal axes of the respective bores.

The pump is mounted on the engine by means of a pair of mounting lugs integrally formed with the lower end of the pump body 10 at a position so that the tappet 20 can be engaged conveniently by a member which is driven by an engine driven cam.

When fuel is spilled into the space 55 through the passages 31A it does so at a high rate and cavities may form in the fuel within the space. The space may be provided with anti-erosion baffles. The fuel can leave the space 55 through the outlet 56 and any cavities which may be present in the fuel can collapse of their own accord. In particular, no cavities will be present in the fuel which is in the space 13 which communicates with the inlet ports 21 and therefore no cavities will reach the inlet ports where their collapse could cause damage to the ports and also to the surface of the plunger. The separation of the spaces 13 and 55 is achieved by an inwardly extending projection 57 formed in the wall of the bore in the body 10. The projection extends inwardly into close proximity with the pump barrel 12 so that the two spaces are substantially isolated from each other.

The pressure pulses in the chamber or space 55 can cause failure of an "O" ring seal 58 which is located in a groove formed in the mounting block 24. The seal co-operates with the wall of the bore in the body and in order to minimize fretting of the seal the mouth of the bore is roller burnished to produce a very smooth surface. Moreover, in order to attenuate the pressure pulses applied to the seal, the volume of the chamber 55 is made as large as possible and in addition the clearance between the valve block 23 and the wall of the bore is made as small as possible. Conveniently the chamber 55 extends in part about the valve block 23.

We claim:

1. A fuel injection pump comprising:

a substantially tubular body having a hollow interior;

a step in said hollow interior of said body;

a pump barrel in said hollow interior of said body having a flanged portion engaging against said step, a first end and a second end;

a bore in said pump barrel having a first end and second end;

a pumping plunger slidably mounted and extending in said bore and having a first end and a second end, said first end of said plunger being adjacent said first end of said bore;

resilient means in said hollow interior of said body between said body and said pumping plunger for biasing said plunger outwardly toward said first end of said board;

means engageable with said pumping plunger for effecting inward movement of said plunger toward said second end of said bore;

a first annular space defined between said pump barrel and said tubular body;

a fuel inlet communicating with said first annular space;

a fuel inlet port in said pump barrel having an outer end communicating with said first annular space and an inner end communicating with said bore, said fuel inlet port being uncovered during outward movement of said plunger to facilitate fuel flow into said bore through said fuel inlet port, said fuel inlet port being closed by said plunger during inward movement of said plunger;

valve block means disposed within said tubular body in engaging relationship against said second end of said pump barrel and closing said second end of said bore;

means for clamping said valve block means against said second end of said pump barrel;

spill valve means in said valve block means for controlling fuel flow from said second end of said bore;

electromagnetically operable valve means operatively connected to said spill valve means for controlling the operation of said spill valve means;

a second annular space defined about said valve block means between said valve block means and said tubular body;

spilled fuel outlet means communicating with said second annular space; and channel means communicating said second end of said bore with said second annular space for spilling fuel from said bore when said spill valve means is operated to terminate delivery of fuel.

2. The fuel injection pump as claimed in claim 1 and further comprising:

an inwardly extending projection on said tubular body between said first and second annular spaces and extending inwardly into said hollow interior of said body into close proximity with said pump barrel.

3. The fuel injection pump as claimed in claim 2 wherein:

said hollow interior is defined by an inner wall on said tubular body; and said first and second annular spaces are formed in said inner wall of said body.

4. The fuel injection pump as claimed in claim 1 wherein:

said valve block means comprises a first valve block having a first end and a second end, said first end of said first valve block engaging against said second end of said pump barrel, and a second valve block having a first end and a second end, said first end of said second valve block engaging against said second end of first valve block;

a mounting block is provided having a part thereof extending into said body and engaging against said second end of said second valve block; and means are provided for securing said mounting block to said body and exerting a clamping force establishing liquid seals between said mounting block and said second end of said second valve block, between said first end of second valve block and said second end of said first valve block, and between said first end of said first valve block and said second end of said pump barrel.

5. The fuel injection pump as claimed in claim 4 and further comprising:

seal means between said mounting block and said body for establishing a fuel tight seal to prevent escape of fuel from said second annular space along a clearance between said second valve block and said body.

6. The fuel injection pump as claimed in claim 4 and further comprising:

a fuel pump outlet in said mounting block;

fuel delivery channel means communicating said second end of said bore with said fuel pump outlet; and fuel delivery valve means in said fuel deliver channel means for controlling the flow of fuel through said fuel delivery channel means.

7. The fuel injection pump as claimed in claim 4 and further comprising:

an inwardly extending projection on said tubular body between said first and second annular spaces and extending inwardly into said hollow interior of said body into close proximity with said pump barrel.

8. The fuel injection pump as claimed in claim 7 wherein:

said hollow interior is defined by an inner wall on said body; and said first and second annular spaces are formed in said inner wall of said body.

9. The fuel injection pump as claimed in claim 7 and further comprising:

seal means between said mounting block and said body for establishing a fuel tight seal to prevent escape of fuel from said second annular space along a clearance between said second valve block and said body.

10. The fuel injection pump as claimed in claim 1 and further comprising:

a fuel pump outlet in said mounting block;

fuel delivery channel means communicating said second end of said bore with said fuel pump outlet; and fuel delivery valve means in said fuel deliver channel means for controlling the flow of fuel through said fuel delivery channel means.

* * * * *